US007683864B2

(12) United States Patent
Lee et al.

(10) Patent No.: US 7,683,864 B2
(45) Date of Patent: Mar. 23, 2010

(54) LED DRIVING APPARATUS WITH TEMPERATURE COMPENSATION FUNCTION

(75) Inventors: Dong Woo Lee, Gyunggi-Do (KR); Soo Ryong Hwang, Gyunggi-Do (KR); Moo Youn Park, Gyunggi-Do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 667 days.

(21) Appl. No.: 11/657,083

(22) Filed: Jan. 24, 2007

(65) Prior Publication Data

US 2007/0171146 A1 Jul. 26, 2007

(30) Foreign Application Priority Data

Jan. 24, 2006 (KR) ..... 10-2006-0007460

(51) Int. Cl.
*G09G 3/32* (2006.01)
*G09G 3/36* (2006.01)
*G09G 5/00* (2006.01)

(52) U.S. Cl. ..... 345/82; 345/102; 345/204

(58) Field of Classification Search ..... 345/82, 345/83, 39, 40, 102, 211, 212, 213
See application file for complete search history.

(56) References Cited

U.S. PATENT DOCUMENTS 6,831,626 B2 12/2004 Nakamura et al.
7,002,547 B2 * 2/2006 Yamada ..... 345/102
7,286,123 B2 * 10/2007 Yang ..... 345/204
7,298,347 B2 * 11/2007 Yamazaki et al. ..... 345/46

FOREIGN PATENT DOCUMENTS

JP 03-095977 4/1991

OTHER PUBLICATIONS

Chinese Office Action, with English Translation, issued in Chinese Patent Application No. CN 200710002657.1, dated Sep. 19, 2008.

* cited by examiner

*Primary Examiner*—Richard Hjerpe
*Assistant Examiner*—Sahlu Okebato
(74) *Attorney, Agent, or Firm*—McDermott Will & Emery LLP

(57) ABSTRACT

An LED driving apparatus having a temperature compensation function includes a reference voltage generator for generating a first reference voltage and a non-inversion amplification unit for performing non-inversion amplification to a difference voltage between the first reference voltage and a forward voltage with a preset gain. A driving unit adjusts a supply voltage in response to the voltage from the non-inversion amplification unit to supply the adjusted supply voltage to a light source having light emitting diodes. A forward voltage detector detects the forward voltage at an anode of the light emitting diodes of the light source to supply the forward voltage to the non-inversion amplification unit. Luminance variation can be compensated according to temperature changes by using a forward voltage of an LED light source so that the forward voltage of the LED light source can be controlled in association with a target current value of ambient temperature.

9 Claims, 4 Drawing Sheets

LED DRIVING APPARATUS WITH TEMPERATURE COMPENSATION FUNCTION

CLAIM OF PRIORITY

This application claims the benefit of Korean Patent Application No. 2006-7460 filed on Jan. 24, 2006, in the Korean Intellectual Property Office, the disclosure of which is incorporated herein by reference.

BACKGROUND OF THE INVENTION

1. Field of the Invention

The present invention relates to a Light Emitting Diode (LED) driving apparatus applicable to a Liquid Crystal Display (LCD) backlight unit, and more particularly, to an LED driving apparatus having a temperature compensation function, which can compensate luminance variation according to temperature changes by using a forward voltage of an LED light source so that the forward voltage of the LED light source is controlled in association with a target current value of ambient temperature, without having to use an optical sensor or temperature sensor or memory or judging means such as CPU, thereby decreasing an installation space, saving manufacturing costs and promoting design flexibility.

2. Description of the Related Art

According to characteristics of LEDs used in an LCD backlight or lighting instrument, their junction resistance is generally variable according to temperature. Therefore, an LED drive apparatus is required to have temperature compensation means.

FIG. 1 is a block diagram of a conventional LED driving unit.

Referring to FIG. 1, the conventional LED driving unit includes a control unit 10 for performing operation control via supply voltage Vcc and feedback voltage Vfd, a driving unit 20 for supplying the supply voltage Vcc in response to the control of the control unit 10, a LED light source 30 including a plurality of LEDs which emit light in response to the supply voltage of the driver 20, an optical sensor 40 for detecting light emitted from the LEDs and a feedback circuit 50 for supplying the feedback voltage Vfd in response to a detection signal by the optical sensor 40 to the control unit 10.

The driving unit 20 is composed of a transistor Q1 that adjusts the supply voltage in response to a supply control signal from the control unit 10.

In the conventional LED driving apparatus, the feedback circuit 50 compares the detection signal by the optical sensor 40 with a reference signal to supply the feedback voltage Vfd, corresponding to an error signal of the comparison result, to the control unit 10. In this case, the control unit 10 varies the supply voltage in response to the feedback voltage Vfd to control the operation of the LEDs.

Such a conventional LED driving apparatus uses an automatic power control process.

For example, when LED light quantity is reduced according to some reasons such as rise in external temperature, monitoring current of PD is also lowered and the comparison result in relation with the reference voltage is fed back proportionally. In this case, the control unit controls the operation in response to the feedback voltage in such a fashion of increasing the collector current of the transistor Q1 of the driving unit so that light quantity can be maintained constantly.

However, the conventional LED driving apparatus uses an expensive photo-sensor or optical sensor for directly monitoring the light quantity of the LEDs. The expensive optical sensor becomes burdensome for a low cost assembly product, which is provided as a set. Furthermore, in case of using RGB LEDs, monitoring necessary for respective wavelengths disadvantageously increases cost burden.

SUMMARY OF THE INVENTION

The present invention has been made to solve the foregoing problems of the prior art and therefore an aspect of certain embodiments of the present invention is to provide an LED driving apparatus applicable to an LCD backlight unit, and more particularly, to an LED driving apparatus having a temperature compensation function, which can compensate luminance variation according to temperature changes by using a forward voltage of an LED light source so that the forward voltage of the LED light source is controlled in association with a target current value of ambient temperature, without having to use an optical sensor or temperature sensor or memory or judging means such as CPU, thereby decreasing an installation space, saving manufacturing costs and promoting design flexibility.

According to an aspect of the invention for realizing the object, the invention provides an LED driving apparatus comprising: a reference voltage generator for generating a first reference voltage; a non-inversion amplification unit for performing non-inversion amplification to a difference voltage between the first reference voltage and a forward voltage with a preset gain; a driving unit for adjusting a supply voltage in response to the voltage from the non-inversion amplification unit to supply the adjusted supply voltage to a light source having light emitting diodes; and a forward voltage detector for detecting the forward voltage at an anode of the light emitting diodes of the light source to supply the forward voltage to the non-inversion amplification unit, whereby temperature change is compensated.

Preferably, the reference voltage generator is adapted to adjust the first reference voltage in response to user selection.

Preferably, the non-conversion amplification unit comprises a non-inversion operation amplifier, which includes: an inversion input terminal connected to a first reference voltage terminal connected from the reference voltage generator; and a non-inversion input terminal connected to a forward voltage terminal of the forward voltage detector.

Also, the inversion input terminal of the non-inversion amplification unit may be connected to the first reference voltage terminal via a first resistor and to an output of the non-inversion operation amplifier via a second resistor, and the non-inversion input terminal of the non-inversion amplification unit is connected to the forward voltage terminal via a third resistor.

Furthermore, the light emitting diode driving apparatus may further include an on/off switch for switching connection between the non-inversion input terminal of the non-inversion amplification unit and the supply voltage terminal to turn on/off the light source and a current limiter for supplies the second reference voltage in place of the output voltage to the driving unit thereby limiting the supply voltage of the driving unit if the output voltage of the non-inversion amplification unit is lower than a preset second reference voltage.

Preferably, the current limiter includes: a comparator for comparing the output voltage of the non-inversion amplification unit with the second reference voltage; and a switch for selecting a larger one of the output voltage of the non-inversion amplification unit and the second reference voltage in response to the comparison result of the comparator.

Preferably, the forward voltage detector includes a buffer operation amplifier for detecting the forward voltage from an anode of the light emitting diodes of the light source to supply the forward voltage to the non-inversion amplification unit.

Preferably, the driving unit includes: a transistor having a base connected to the output terminal of the non-inversion amplification unit, an emitter connected to the supply voltage terminal via a resistor and a collector connected to the anode of the light emitting diodes of the light source; a capacitor connected to the base of the transistor and the supply voltage terminal to suppress excessive voltage from the switching of the transistor; and a diode having a cathode connected to the base of the transistor and an anode grounded.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described more fully hereinafter with reference to the accompanying drawings, in which the same reference signs are used to designate the same or similar components throughout.

Figure 1:
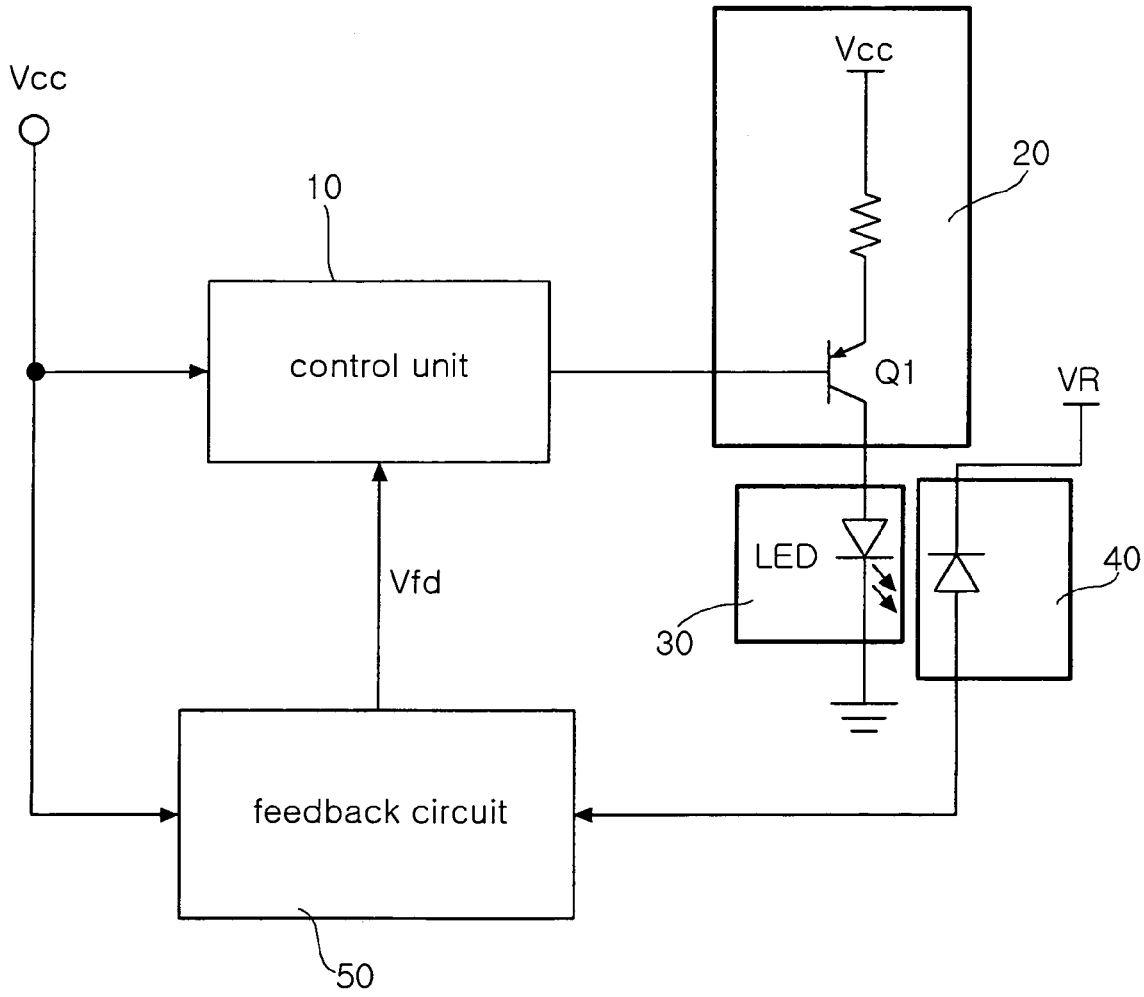
PRIOR ART FIG. 1
FIG. 1 is a block diagram of a conventional LED driving apparatus.
Figure 2:
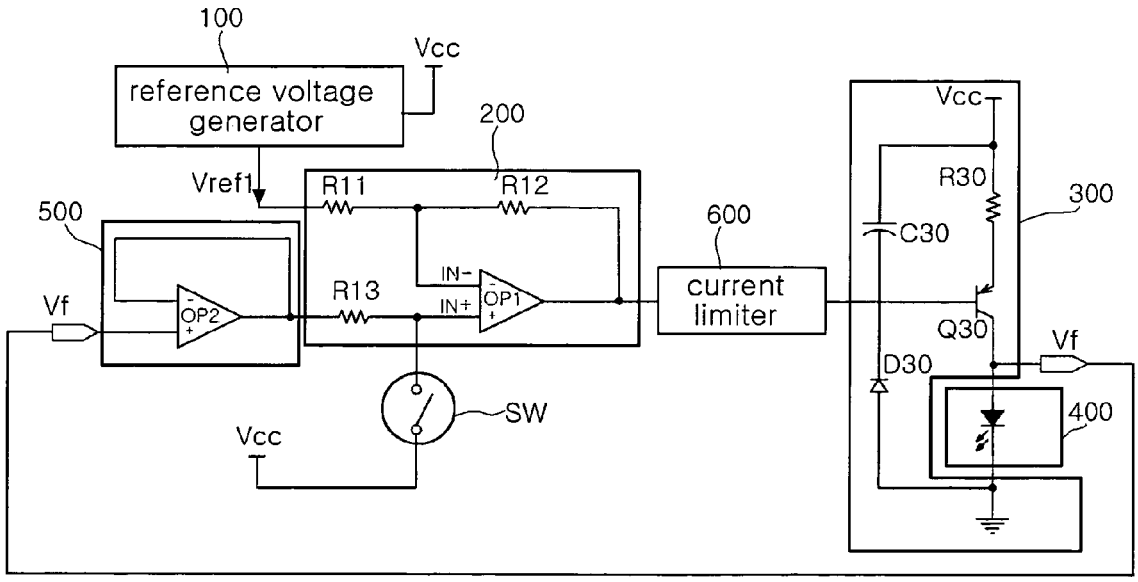
FIG. 2 is a block diagram of an LED driving apparatus of the invention.

FIG. 2 is a block diagram of an LED driving apparatus of the invention.

Referring to FIG. 2, the LED driving apparatus of the invention includes a reference voltage generator 100 for generating a first reference voltage Vref1, a non-inversion amplification unit 200 for performing non-inversion amplification to a difference voltage between the first reference voltage Vref1 and a forward voltage Vf with a preset gain Av, a driving unit 300 for adjusting a supply voltage in response to the voltage from the non-inversion amplification unit 200 to supply the adjusted supply voltage to an LED light source 400 and a forward voltage detector 500 for detecting the forward voltage Vf at an anode of LEDs of the LED light source 400 to supply the forward voltage Vf to the non-inversion amplification unit 200.

The LED driving apparatus of the invention further includes an on/off switch SW and a current limiter 600. The on/off switch SW acts to switch the connection between a non-inversion input terminal In+ and a supply voltage (Vcc) terminal to turn on/off the operation of the LED light source 400. The current limiter 600, if the output voltage of the non-inversion amplification unit 200 is lower than a preset second reference voltage Vref2, supplies the second reference voltage Vref2 in place of the output voltage to the driving unit 300, thereby limiting the supply voltage of the driving unit 300.

The reference voltage generator 100 is configured to adjust the first reference voltage Vref1 in response to user selection. The first reference voltage Vref1 can be adjusted by a variable resistor that can adjust division ratio of the supply voltage Vcc.

The non-inversion amplification unit 200 includes a non-inversion operation amplifier OP1 having an inversion input terminal In− connected to the first reference voltage Vref1 from the reference voltage generator 100. The non-inversion input terminal In+ of non-inversion operation amplifier OP1 is connected to the forward voltage Vf of the forward voltage detector 500.

In the non-inversion amplification unit 200, the inversion input terminal In− is connected to the first reference voltage (Vref1) terminal via a first resistor R11 and to the output of the non-inversion operation amplifier OP1 via a second resistor R12, and the non-inversion input terminal In+ is connected to the forward voltage (Vf) terminal via a third resistor R13.

Figure 3:
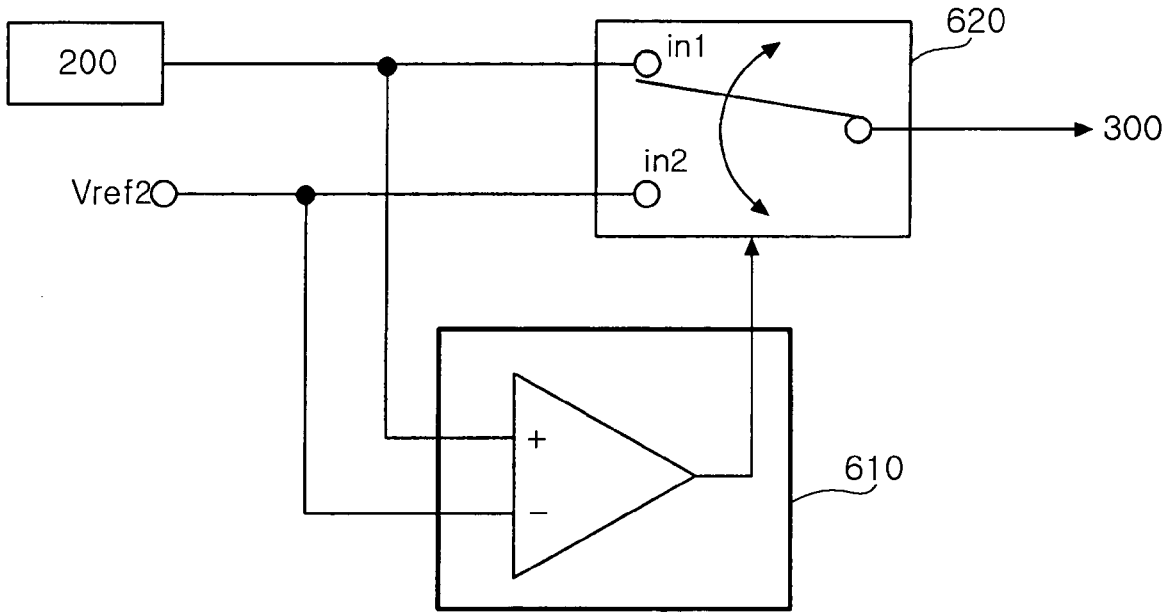
FIG. 3 is a circuit diagram of the current limiter shown in FIG. 2.

FIG. 3 is a circuit diagram of the current limiter shown in FIG. 2.

Referring to FIGS. 2 and 3, the current limiter 600 includes a comparator 610 for comparing the output voltage of the non-inversion amplification unit 200 with the second reference voltage and a switch 620 for selecting a voltage in response to the comparison result of the comparator. The switch 620 selects a larger one of the output voltage of the non-inversion amplification unit 200 and the second reference voltage Vref2.

The forward voltage detector 500 includes a buffer operation amplifier OP2 for detecting the forward voltage Vf from an anode of LEDs of the LED light source 400 to supply the forward voltage Vf to the non-inversion amplification unit 200. Describing in more detail, the driving unit 300 includes a transistor Q30 having a base connected to the output terminal of the non-inversion amplification unit 200, an emitter connected to the supply voltage (Vcc) terminal via a resistor R30 and a collector connected to the anode of the LEDs of the LED light source 400; a capacitor C30 connected to the base of the transistor Q30 and the supply voltage (Vcc) terminal to suppress excessive voltage from the switching of the transistor Q30; and a diode D30 having a cathode connected to the base of the transistor Q30 and an anode grounded.

Figure 4:
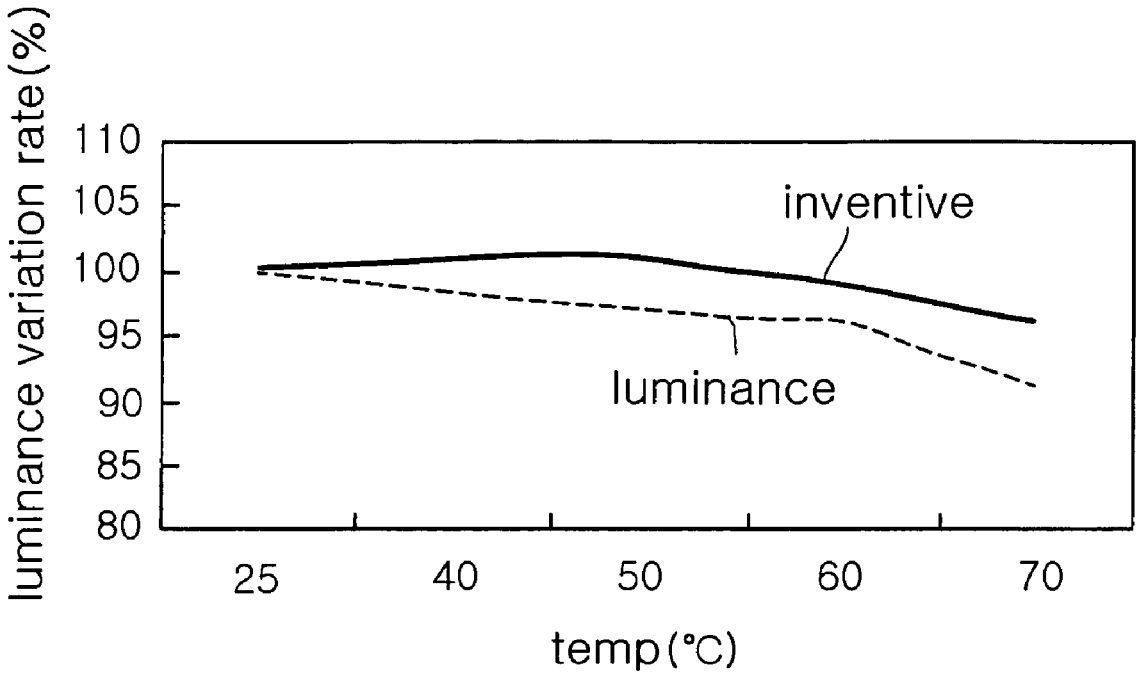
FIG. 4 is a graph illustrating luminance variation-temperature characteristics of the inventive and conventional LED driving apparatuses.

FIG. 4 is a graph illustrating brightness variation-temperature characteristics of the inventive and conventional LED driving apparatuses.

Referring to FIG. 4, it is appreciated that the temperature-luminance variation rate of an LED driving apparatus of the invention is improved than that of a conventional LED driving apparatus.

Hereinafter the operations and effects of the invention will be described in detail in conjunction with the accompanying drawings.

The LED driving apparatus of the invention will be described with reference to FIGS. 2 to 4. First, as shown in FIG. 2, the reference generator 100 generates a first reference voltage Vref1 to be supplied to the non-inversion amplification unit 200. Here, the first reference voltage Vref1 of the reference voltage generator 100 may be adjusted by the user.

Then, the non-inversion amplification unit 200 of the invention performs non-inversion amplification to the difference voltage between the first reference voltage from the reference voltage generator 100 and a forward voltage Vf with a preset gain Av and supplies the amplified difference voltage to the driving unit 300 to adjust the supply voltage of the driving unit.

Here, the forward voltage detector 500 of the invention detects the forward voltage Vf at the anode of the LEDs of the LED light source 400 and supplies the detected forward voltage Vf to the non-inversion amplification unit 200. The LED light source 400 includes a plurality of LEDs, in which the forward voltage detector 500 detects the forward voltage Vf at the respective anodes of the LEDs.

The non-inversion amplification unit 200 will now be described in more detail In the non-inversion amplification unit 200, the non-inversion operation amplifier OP1 performs non-inversion amplification to the first reference voltage Vref1 inputted through the inversion input terminal In− and the forward voltage Vf inputted from the forward voltage detector 400 through the non-inversion input terminal In+.

That is, the non-inversion operation amplifier OP1 amplifies the difference voltage between the first reference voltage Vref1 and the forward voltage Vf with a non-inversion gain Av, which is determined by the first resistor R11 connected to the inversion input terminal In−, the second resistor R12 connected to the output and the third resistor R13 connected to the non-inversion input terminal In+. The first reference voltage Vref1 is variable, and the non-inversion amplification gain and the output voltage Vo processed with the non-inversion amplification are as in Equation 1 below:

$$Vo = \left(1 + \frac{R12}{R11}\right)(Vf - Vref) - Av(Vr - Vref1), \quad \text{Equation 1}$$

where Vo is the output voltage of the non-inversion amplification unit 200, Vf is the forward voltage, and Vref1 is the first reference voltage.

The user can turn on/off the LEDs by using the on/off switch SW, which will be described as follows.

First, when the non-inversion terminal In+ of the non-inversion amplification unit 20 is connected to the supply voltage (Vcc) terminal via the on/off switch SW, a high level voltage is applied to the base of the transistor Q30 of the driving unit 300 to switch off the PNP type transistor Q30, thereby turning off the LED light source 400 of the invention.

On the other hand, when the non-inversion input terminal In+ of the non-inversion amplification unit 200 is separated from the supply voltage (Vcc) terminal through the on/off switch SW, the output voltage of the non-inversion amplification unit 200 is applied to the base of the transistor Q30 of the driving unit 300. Then, the PNP type transistor Q30 operates in response to the output voltage of the non-inversion amplification unit 200 to adjust the supply voltage of the driving unit 300 and thus the brightness of the LED light source 400.

In addition, when the output voltage Vo of the non-inversion amplification unit 200 is lower than the preset second reference voltage Vref2, the current limiter 600 shown in FIG. 2 outputs the second reference voltage Vref2 in place of the output voltage Vo to the driving unit 300 to limit the supply current of the driving unit 300, which will be described in detail with reference to FIG. 3.

Referring to FIG. 3, the comparator 610 of the current limiter 600 compares the output voltage of the non-inversion amplification unit 200 with the second reference voltage Vref2 and sends the comparison result as a switching control signal to the switch 620. Then, the switch 620 makes a selection according to the comparison result of the comparator 610. That is, the switch 620 selects a larger one of the output voltage of the non-inversion amplification unit 200 and the second reference voltage Vref2.

The forward voltage detector 500 is composed of the buffer operation amplifier OP2 that is a voltage follower, and detects the forward voltage Vf from an anode of the LEDs of the LED light source 400 and supplies the detected forward voltage to the non-inversion amplification unit 200. The buffer operation amplifier OP2 supplies the forward voltage Vf to the non-inversion amplification unit 200 without specific signal amplification, and is used for signal isolation rather than signal amplification.

On the other hand, the PNP type transistor Q30 of the driving unit 300 adjusts the supply voltage flowing from the supply voltage (Vcc) terminal to the ground in response to the output voltage Vo of the non-inversion amplification unit 200 applied to the base.

In addition, the value of the resistor R30 connected to the emitter of the transistor Q30 can be adjusted to drive the LEDs with desired luminance and current values.

Here, the capacitor C30 connected to the base of the transistor Q30 and the supply voltage (Vcc) terminal can suppress excessive voltage by switching operation of the transistor Q30. The diode D30 having a cathode connected to the base of the transistor Q30 and a grounded anode, in response to a negative (−) voltage unexpectedly occurring at the output of the non-inversion amplification unit 200, prevents abrupt drop in the voltage applied to the base of the transistor Q30, which otherwise causes excessive current. That is, the diode D30 allows clipping as much as the forward voltage (e.g., about 0.7V) thereof.

Accordingly, the LED driving apparatus of the invention can realize desired operation characteristics by setting the reference voltage and adjusting the value of the emitter resistor R30 of the transistor. Furthermore, according to the LED driving apparatus of the invention, it is possible to compensate temperature changes without any specific optical sensor thereby constantly controlling the luminance of the LEDs.

For example, in a case where ambient temperature rises, the LED brightness or luminance is reduced and the supply voltage is lowered in response to the temperature rise.

In this circumstance, the forward voltage Vf is reduced and the output voltage of the non-inversion amplification unit is also reduced according to Equation 1 above. Since the output voltage of the non-inversion amplification unit is applied to the base of the transistor of the driving unit, the emitter voltage of the transistor is also reduced in response to the reduced base voltage. This as a result increases the emitter voltage. Like this, the emitter current is substantially equal with the collector current and thus the LEDs are driven with the increased current.

Through the above procedures, in case of rise in ambient temperature, although the LEDs are apt to lower the luminance, the operation control is performed to increase the supply current according to the invention. As a result, ambient temperature changes can be compensated by the apparatus of the invention better than the conventional apparatus as shown in FIG. 4 so that a specific value of luminance can be maintained constantly.

According to the invention as described above, in the LED driving apparatus applicable to an LCD backlight unit, luminance variation can be compensated according to temperature changes by means of a forward voltage of an LED light source so that the forward voltage of the LED light source is controlled in association with a target current value of ambient temperature. This can be realized without the use of an optical sensor or temperature sensor or memory or judging means such as CPU, thereby decreasing an installation space, saving manufacturing costs and promoting design flexibility.

While the present invention has been described with reference to the particular illustrative embodiments and the accompanying drawings, it is not to be limited thereto but will be defined by the appended claims. It is to be appreciated that those skilled in the art can substitute, change or modify the embodiments into various forms without departing from the scope and spirit of the present invention.

What is claimed is:

1. A light emitting diode driving apparatus comprising:

a reference voltage generator for generating a first reference voltage;

a non-inversion amplification unit for performing non-inversion amplification to a difference voltage between the first reference voltage and a forward voltage with a preset gain;

a driving unit for adjusting a supply voltage in response to the voltage from the non-inversion amplification unit to supply the adjusted supply voltage to a light source having light emitting diodes; and a forward voltage detector for detecting the forward voltage at an anode of the light emitting diodes of the light source to supply the forward voltage to the non-inversion amplification unit, whereby temperature change is compensated.

2. The light emitting diode driving apparatus according to claim 1, wherein the reference voltage generator is adapted to adjust the first reference voltage in response to user selection.

3. The light emitting diode driving apparatus according to claim 1, wherein the non-conversion amplification unit comprises a non-inversion operation amplifier, which includes:

an inversion input terminal connected to a first reference voltage terminal connected from the reference voltage generator; and a non-inversion input terminal connected to a forward voltage terminal of the forward voltage detector.

4. The light emitting diode driving apparatus according to claim 3, wherein the inversion input terminal of the non-inversion amplification unit is connected to the first reference voltage terminal via a first resistor and to an output of the non-inversion operation amplifier via a second resistor, and the non-inversion input terminal of the non-inversion amplification unit is connected to the forward voltage terminal via a third resistor.

5. The light emitting diode driving apparatus according to claim 3, further comprising an on/off switch for switching connection between the non-inversion input terminal of the non-inversion amplification unit and the supply voltage terminal to turn on/off the light source.

6. The light emitting diode driving apparatus according to claim 3, further comprising a current limiter for supplies the second reference voltage in place of the output voltage to the driving unit thereby limiting the supply voltage of the driving unit if the output voltage of the non-inversion amplification unit is lower than a preset second reference voltage.

7. The light emitting diode driving apparatus according to claim 6, wherein the current limiter includes:

a comparator for comparing the output voltage of the non-inversion amplification unit with the second reference voltage; and a switch for selecting a larger one of the output voltage of the non-inversion amplification unit and the second reference voltage in response to the comparison result of the comparator.

8. The light emitting diode driving apparatus according to claim 3, wherein forward voltage detector includes a buffer operation amplifier for detecting the forward voltage from an anode of the light emitting diodes of the light source to supply the forward voltage to the non-inversion amplification unit.

9. The light emitting diode driving apparatus according to claim 3, wherein the driving unit includes:

a transistor having a base connected to the output terminal of the non-inversion amplification unit, an emitter connected to the supply voltage terminal via a resistor and a collector connected to the anode of the light emitting diodes of the light source;

a capacitor connected to the base of the transistor and the supply voltage terminal to suppress excessive voltage from the switching of the transistor; and a diode having a cathode connected to the base of the transistor and an anode grounded.

* * * * *